US009877137B2

(12) United States Patent
Saunders

(10) Patent No.: US 9,877,137 B2
(45) Date of Patent: Jan. 23, 2018

(54) SYSTEMS AND METHODS FOR PLAYING A VENUE-SPECIFIC OBJECT-BASED AUDIO

(71) Applicant: Disney Enterprises, Inc., Burbank, CA (US)

(72) Inventor: Brian Saunders, Canyon County, CA (US)

(73) Assignee: Disney Enterprises, Inc., Burbank, CA (US)

( * ) Notice: Subject to any disclaimer, the term of this patent is extended or adjusted under 35 U.S.C. 154(b) by 38 days.

(21) Appl. No.: 14/876,723

(22) Filed: Oct. 6, 2015

(65) Prior Publication Data

US 2017/0099557 A1 Apr. 6, 2017

(51) Int. Cl.

| | |
|---|---|
| ***H04R 5/02*** | (2006.01) |
| ***H04R 3/00*** | (2006.01) |
| ***H04S 7/00*** | (2006.01) |
| *H04R 27/00* | (2006.01) |

(52) U.S. Cl.

CPC ..... *H04S 7/305* (2013.01); *H04R 27/00* (2013.01); *H04S 2420/03* (2013.01)

(58) Field of Classification Search

CPC ..... H04S 2400/11; H04S 7/30; H04S 7/305; H04S 7/302; H04S 7/308; H04S 2420/03; H04S 3/008; H04S 5/005; G10L 19/008; H04R 5/04; H04R 5/02; H04R 2205/024; H04R 3/00; H04R 3/12; H04R 2430/00; G06F 3/165

See application file for complete search history.

(56) References Cited

U.S. PATENT DOCUMENTS

| | | | | |
|---|---|---|---|---|
| 7,251,337 | B2 | 7/2007 | Jacobs | |
| 7,551,745 | B2 | 6/2009 | Gundry | |
| 8,396,575 | B2 | 3/2013 | Kraemer | |
| 8,687,829 | B2 | 4/2014 | Hilpert | |
| 8,954,175 | B2 | 2/2015 | Smaragdis | |
| 9,031,268 | B2 | 5/2015 | Fejzo | |
| 2009/0220104 | A1 | 9/2009 | Allison | |
| 2013/0114819 | A1* | 5/2013 | Melchior | H04S 7/30 381/59 |
| 2014/0119551 | A1 | 5/2014 | Bharitkar | |

(Continued)

FOREIGN PATENT DOCUMENTS

| | | |
|---|---|---|
| WO | WO 2014/036121 | 3/2014 |
| WO | WO 2014/165668 | 10/2014 |

OTHER PUBLICATIONS

"Evaluation of a three-way omnidirectional sound source for room impulse response measurements" by: David A. Dick et al., Jul. 1, 2015, pp. 1-2.

(Continued)

*Primary Examiner* — Thang Tran

(74) *Attorney, Agent, or Firm* — Farjami & Farjami LLP

(57) ABSTRACT

There is provided a system and method for playing a venue-specific object-based audio in a venue, the system comprising a memory, and a processor configured to receive an object-based audio including a plurality of audio components and create a venue-specific object-based audio based on a modification metadata by adjusting a level of at least one of the plurality of audio components of the object-based audio, the processor executing the object-based audio rendering software to render the venue-specific object-based audio in the venue.

18 Claims, 3 Drawing Sheets

(56) References Cited

U.S. PATENT DOCUMENTS

| | | | | |
|---|---|---|---|---|
| 2014/0133683 | A1* | 5/2014 | Robinson | H04S 3/008 381/303 |
| 2015/0223002 | A1* | 8/2015 | Mehta | H04S 7/30 381/303 |
| 2016/0295343 | A1* | 10/2016 | Tsingos | H04S 7/308 |

OTHER PUBLICATIONS

"REW—Room EQ Wizard Room Acoustics Software" by: Guy-Bait Stan et al., Jul. 1, 2015, pp. 1-3.
"Object-Based Audio: Opportunities for Improved Listening Experience and Increased Listener Involvement" by: Robert Bleidt, MPEG-H Fraunhofer SMPTE Oct. 2014, pp. 1-36.

* cited by examiner

SYSTEMS AND METHODS FOR PLAYING A VENUE-SPECIFIC OBJECT-BASED AUDIO

BACKGROUND

As audio technology has advanced, the audio experience of a movie has become increasingly complex, with surround-sound and three-dimensional (3D) audio providing listeners with increasingly immersive listening experiences. Audio for movies is mixed and produced in sound studios and are optimized for audio excellence, however, when the audio is played back in real-world venue settings, a listener's experience may be diminished due to audio interferences existing in each specific venue.

SUMMARY

The present disclosure is directed to systems and methods for playing a venue-specific object-based audio, substantially as shown in and/or described in connection with at least one of the figures, as set forth more completely in the claims.

DETAILED DESCRIPTION

Figure 1:
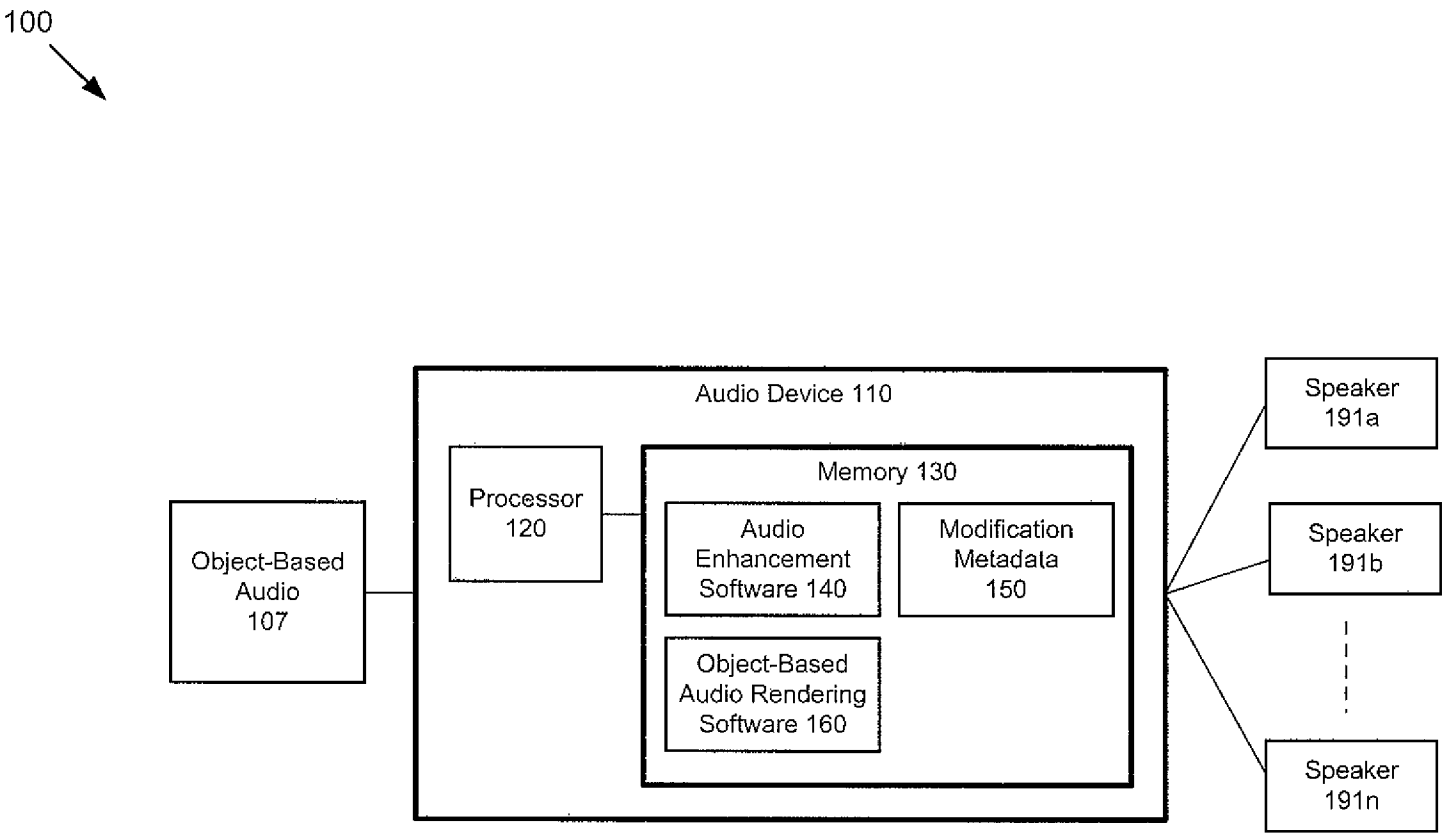
FIG. 1 shows a diagram of an exemplary system for playing a venue-specific object-based audio, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 shows a diagram of an exemplary system for playing a venue-specific object-based audio, according to one implementation of the present disclosure. System 100 includes object-based audio 107, audio device 110, and speakers 191*a*-191*n*. Audio device 110 includes processor 120 and memory 130. Processor 120 is a hardware processor, such as a central processing unit (CPU) used in computing devices. Memory 130 is a non-transitory storage device for storing software for execution by processor 120, and also storing various data and parameters. Memory 130 includes audio enhancement software 140, modification metadata 150, and object-based audio rendering software 160.

Object-based audio 107 may be an audio of a movie or other production, such as a stage play, and may include a plurality of audio components, such as a dialog component, a music component, and an effects component. Object-based audio 107 may include an audio bed and a plurality of audio objects, where the audio bed may include traditional static audio elements, bass, treble, and other sonic textures that create the bed upon which object-based directional and localized sounds may be built. Audio objects in object-based audio 107 may be localized or panned around and above a listener in a multidimensional sound field, creating an audio experience for the listener in which sounds travel around the listener. In some implementations, an audio object may include audio from one or more audio components.

In order to create a venue-specific audio, system 100 may use audio enhancement software 140, which is a computer algorithm stored in memory 130 for execution by processor 120. Audio enhancement software 140 may adjust a level or playback volume of an audio component or an audio object. In some implementations, audio enhancement software 140 may create a unique audio mix for a venue, where a venue may be a theater such as a movie theater, a theater for live performances, or an outdoor theater such as an amphitheater. In other implementations, audio enhancement software 140 may optimize playback of object-based audio 107 for the venue. In some implementations, system 100 may be used to create a venue-specific audio in a non-standard venue, where a non-standard venue may be a theater having dimensions that are not designed for movie audio, or a non-standard venue may be an outdoor venue.

Each venue, including non-standard venues, may have inherent venue-specific parameters that may affect a listener's experience of an audio played in the venue. Venue-specific parameters may include the dimensions of the venue including the length, width, height, and, accordingly, the physical volume of the venue, the shape of the venue, RT60 values of the venue, high audience listening position reverberant field balance (direct field to reverberant field ratio), physical venue issues such as hard reflective surface areas, projection screens, balconies, hard rear walls, hard floors, etc. An RT60 value is the time which it takes for the sound level to decay about 60 dB in a reverberant environment, and the RT60 sound level measurements may be taken in one-third octave or full octave frequency bands. Additional considerations may include the presence of slap or flutter echoes between acoustically reflective surfaces, issues arising in outdoor venues, such as venues with high ambient noise levels from sources such as air conditioning or proximity to other noise sources with a noise criterion greater than about 30.

In the context of non-standard venues, audio enhancement software 140 may modify a production mix or create a venue-specific mix using venue-specific parameters to independently adjust the relative levels of a dialog component of object-based audio 107, a music component of object-based audio 107, and/or an effects component of object-based audio 107. Additionally, audio enhancement software 140 may adjust a surround balance or an overhead balance of any component of object-based audio 107 to counteract the negative impacts on the production mix encountered during playback in non-standard venues. Audio enhancement software 140 may modify object-based audio 107 using modification metadata 150. Modification metadata 150 is metadata used to modify object-based audio 107 based on venue-specific parameters. In some implementations, modification metadata 150 may include information about a venue that may affect audio playback, such as venue-specific parameters.

Object-based audio rendering software 160 is a computer algorithm stored in memory 130 for execution by processor 120 to render object-based audio such as a venue-specific audio based on object-based audio 107 and modification metadata 150. In some implementations, object-based audio rendering software 160 may render the venue-specific audio by converting object-based audio 107 and the venue-specific metadata into an audio signal that may be used to generate a sound using a loudspeaker before transmitting the venue-specific audio to a plurality of loudspeakers in the venue.

Speakers 191*a*-191*n* may include a plurality of speakers, which are connected to audio device 110. In some implementations, speakers 191*a*-191*n* may include a plurality of front speakers, a plurality of surround speakers for delivering surround-sound audio, a plurality of overhead speakers for delivering surround-sound or 3D audio, and a subwoofer or a plurality of subwoofers for delivering low-frequency audio. Speakers 191*a*-191*n* may be oriented substantially in a two-dimensional (2D) plane, or in a 3D configuration. A 3D configuration may include overhead speakers and/or ceiling-mounted speakers, where overhead speakers may be speakers that create an elevated sound layer, but are not necessarily ceiling-mounted, and may be used in addition to ceiling-mounted speakers.

Figure 2:
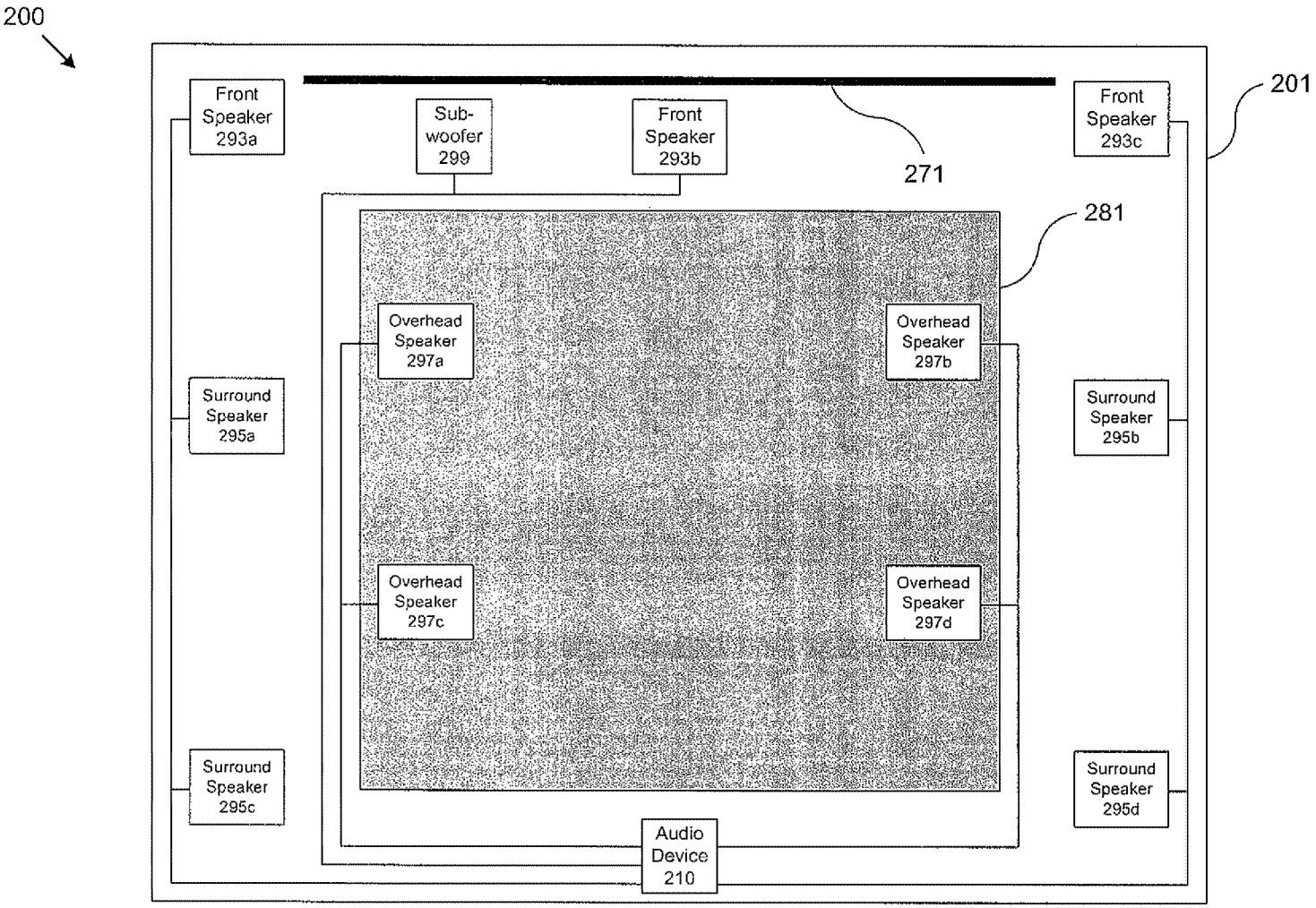
FIG. 2 shows an exemplary environment utilizing the system of FIG. 1, according to one implementation of the present disclosure.

FIG. 2 shows an exemplary environment utilizing the system of FIG. 1, according to one implementation of the present disclosure. Diagram 200 shows theater 201 including audio device 210, screen 271, audience seating area 281, front speakers 293*a*-293*c*, surround speakers 295*a*-295*d*, overhead speakers 297*a*-297*d*, and subwoofer 299. Although FIG. 2 shows three front speakers 293*a*-293*c*, system 100 may function with any number of front speakers. Similarly, the number of surround speakers 295*a*-295*d*, overhead speakers 297*a*-297*d*, and subwoofer 299 shown in FIG. 2 should not be taken as a limitation on the number or type of speakers required by system 100.

Figure 3:
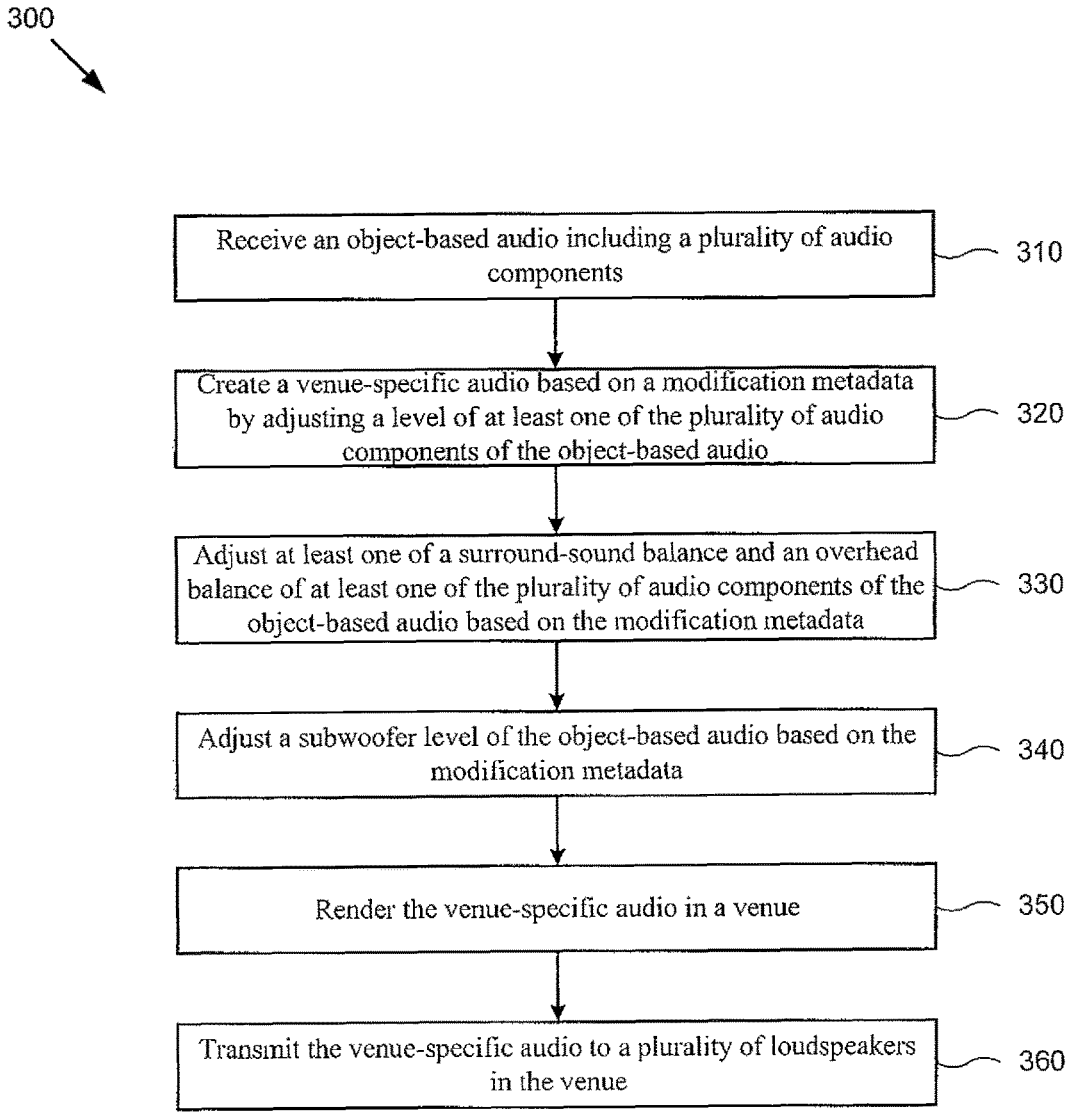
FIG. 3 shows a flowchart illustrating an exemplary method of playing a venue-specific object-based audio, according to one implementation of the present disclosure.

FIG. 3 shows a flowchart illustrating an exemplary method of playing a venue-specific object-based audio, according to one implementation of the present disclosure. Flowchart 300 begins at 310, where audio device 110 receives object-based audio 107 including a plurality of audio components. In some implementations, object-based audio 107 may be the audio of a movie or a recorded audio portion of a performance, such as a live performance including music, sound effects, and/or dialog of a character, such as a robotic character, an animatronic character, or a puppet character.

At 320, audio device 110 creates a venue-specific audio based on modification metadata 150 by adjusting a level of at least one of the plurality of audio components of the object-based audio. Modification metadata 150 may be layered over object-based audio 107 to adjust a level of a component of object-based audio 107, such as the dialog component of object-based audio 107, the music component of object-based audio 107, and/or the effects component of object-based audio 107. Audio enhancement software 140 may layer modification metadata 150 over metadata existing in object-based audio 107. In some implementations, audio enhancement software 140 may use modification metadata 150 to adjust the relative level of the dialog component, the music component, the effects component and/or surround immersiveness of a sound balance based on acoustic properties of the venue. Acoustic properties of the venue may include reverberation, the production of standing waves and the fact that bass frequencies need at least one quarter of their cycle to fully form. Creating sound within an enclosed space may result in reverberation. Reverberation may be caused by the sound waves that are reflected off any surfaces in the venue, e.g., walls, ceilings, floors etc., creating echoes of the original sound. After the original sound has stopped, the echoes may continue for a period of time, gradually decreasing in amplitude until they are no longer audible. Standing waves occur when the wavelength of the audio is the same length as the distance between two parallel walls in a room and the produced sound wave bounces off one wall and is reflected back, constructively interfering with the wave coming from the sound source.

Modification metadata 150 may be obtained by testing acoustic properties of a venue and/or evaluation of a reference mix audio. Additionally, system 100 may allow further adjustment of the playback level of each component of object-based audio 107 by a creative team of a production or a technical staff of a production during rehearsals to create an optimized venue-specific mix.

Acoustic parameters of a venue may be measured to determine the presence of negative effects, such as long reverberation times in large venues, which may interfere with dialog intelligibility and/or the surround ambiance balance. In some implementations, acoustic parameters may be obtained by taking a measurement of acoustic properties of the venue using a microphone to record the sound at a location in the venue. The measurement may be taken at a single location in the venue, such as the middle of the venue about two-thirds of the way from the front wall to the back wall, or measurements may be taken in a plurality of locations throughout the venue. Once measurements of the venue's acoustic parameters have been taken, they may be used to create modification metadata 150. For example, the playback level of the dialog component of object-based audio 107 may be increased relative to the music component of object-based audio 107 and the effects component of object-based audio 107 to make dialog more intelligible during various parts the movie. Alternatively, the level of the music component of object-based audio 107 and/or the effects component of object-based audio 107 may be decreased relative to the dialog component of object-based audio 107 in venues with higher RT60 values to reduce the interference caused by echoes. As another example, the subwoofer component of object-based audio 107 may be decreased in a venue that has low-frequency buildup.

Modification metadata 150 may be in the form of user created generic presets, or modification metadata 150 may be dynamic and/or movie specific, depending on the media content and any particular venue challenges, such as challenges arising in an outdoor venue. For example, a large outdoor venue with a lot of background noise may benefit from a continuous change in volume of one or more components of object-based audio 107. Such continuous adjustment may allow the audience to hear dialog during chaotic or loud portions of the movie by reducing the relative volume of background music and/or effects, or by increasing the relative volume of dialog during scenes with quiet speech.

At 330, audio device 110 adjusts at least one of a surround-sound balance and an overhead balance of at least one of the plurality of audio components of object-based audio 107 based on the modification metadata. In some implementations, audio device 110 may adjust the surround balance of one or more audio components, such as the dialog component, the music component, and/or the effects component based on modification metadata 150 to implement the venue-specific audio. In some implementations, audio device 110 may adjust the overhead balance of one or more audio components such as the dialog component, the music component, and/or the effects component based on modification metadata 150 to implement the venue-specific audio. In some implementations, very long low-frequency reverberation times or venue resonance may require an adjustment to an effects and/or music component of a subwoofer mix level to avoid undesirable excess low frequency buildup. At 340, audio device 110 adjusts a subwoofer level of the object-based audio based on modification metadata 150.

At 350, audio device 110 renders the venue-specific audio in the venue. Object-based audio rendering software 160 may render the venue-specific audio for playback in the venue by converting object-based audio 107 and the venue-specific metadata into an audio signal that may be used to generate a sound using a loudspeaker. Flowchart 300 continues at 360, where audio device 110 transmits the venue-specific audio to a plurality of loudspeakers in the venue. In some implementations, the plurality of loudspeakers may be arranged in a conventional surround-sound configuration, wherein the speakers are substantially within a 2D plane, or the plurality of speakers may be arranged in a 3D configuration, with some speakers having a different elevation relative to the listener. In other implementations, the plurality of speakers may include a 2D configuration including upward facing speakers oriented to direct sound towards the ceiling, emulating a 3D speaker configuration with the sound reflected off of the ceiling replacing overhead or ceiling mounted speakers.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A system for playing a venue-specific object-based audio in a venue, the system comprising:

a memory storing an audio enhancement software, a modification metadata, and an object-based audio rendering software; and a processor executing the audio enhancement software to:

receive an object-based audio including a plurality of audio components; and create the venue-specific object-based audio based on the modification metadata by adjusting a level of at least one of the plurality of audio components of the object-based audio;

the processor executing the object-based audio rendering software to:

render the venue-specific object-based audio in the venue;

wherein the modification metadata is based on one or more venue-specific measured parameters obtained by measuring one or more acoustic properties of the venue.

2. The system of claim 1, wherein the processor is further configured to:

transmit the venue-specific object-based audio to a plurality of loudspeakers in the venue.

3. The system of claim 1, wherein the plurality of audio components include a dialog component, a music component, and an effects component.

4. The system of claim 1, wherein creating the venue-specific object-based audio includes adjusting at least one of a surround-sound balance and an overhead balance of at least one of the plurality of audio components of the object-based audio based on the modification metadata.

5. The system of claim 1, wherein creating the venue-specific object-based audio includes adjusting a suhwoofer level of the object-based audio based on the modification metadata.

6. The system of claim 1, wherein the modification metadata includes static modifications.

7. The system of claim 1, wherein the modification metadata includes one of dynamic modifications and film-specific modifications.

8. The system of claim 1, wherein measuring the one or more acoustic properties of the venue comprises recording, using a microphone, a sound at one or more locations in the venue.

9. The system of claim 8, wherein the one or more acoustic properties of the venue include at least one of a reverberation time of the venue, a low-frequency reverberation time of the venue, and a resonance of the venue.

10. A method for playing a venue-specific object-based audio in a venue using an audio system including a memory storing a modification metadata and a processor, the method comprising:

receiving, using the processor, an object-based audio including a plurality of audio components;

creating, using the processor, the venue-specific object-based audio by adjusting a level of at least one of the plurality of audio components based on the modification metadata; and rendering, using the processor, the venue-specific object-based audio in the venue;

wherein the modification metadata is based on one or more venue-specific measured parameters obtained by measuring one or more acoustic properties of the venue.

11. The method of claim 10, wherein the processor is further configured to:

transmit the modified audio to a plurality of loudspeakers in the venue.

12. The method of claim 10, wherein the plurality of audio components include a dialog component, a music component, and an effects component.

13. The method of claim 10, wherein creating the venue-specific object-based audio includes adjusting at least one of a surround-sound balance and an overhead balance of at least one of the plurality of audio components of the object-based audio based on the modification metadata.

14. The method of claim 10, wherein creating the venue-specific audio includes adjusting a subwoofer level of the object-based audio based on the modification metadata.

15. The method of claim 10, wherein the modification metadata includes static modifications.

16. The method of claim 10, wherein the modification metadata includes one of dynamic modifications and film-specific modifications.

17. The method of claim 10, wherein measuring the one or more acoustic properties of the venue comprises recording, using a microphone, a sound at one or more locations in the venue.

18. The method of claim 17, wherein the one or more acoustic properties of the venue include at least one of a reverberation time of the venue, a low-frequency reverberation time of the venue, and a resonance of the venue.

* * * * *